US009051876B2

(12) United States Patent
Sato et al.

(10) Patent No.: US 9,051,876 B2
(45) Date of Patent: Jun. 9, 2015

(54) HEAT-SHIELDING FILM AND METHOD OF FORMING THE SAME

(75) Inventors: Takayasu Sato, Toyota (JP); Yoshinori Takeuchi, Toyota (JP); Takeshi Utsunomiya, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 82 days.

(21) Appl. No.: 13/988,634

(22) PCT Filed: Dec. 1, 2011

(86) PCT No.: PCT/IB2011/002890

§ 371 (c)(1),
(2), (4) Date: May 21, 2013

(87) PCT Pub. No.: WO2012/073101

PCT Pub. Date: Jun. 7, 2012

(65) Prior Publication Data

US 2013/0239924 A1 Sep. 19, 2013

(30) Foreign Application Priority Data

Dec. 2, 2010 (JP) ..... 2010-269567

(51) Int. Cl.
*F02B 77/11* (2006.01)
*F02B 77/02* (2006.01)

(52) U.S. Cl.
CPC ..... *F02B 77/11* (2013.01); *Y10T 29/49231* (2015.01); *F02B 77/02* (2013.01); *F05C 2203/08* (2013.01); *F05C 2203/0878* (2013.01); *F05C 2203/0886* (2013.01)

(58) Field of Classification Search
CPC .. F02B 77/11; F02B 77/02; F05C 2203/0886; F05C 2203/0878; F05C 2203/08; F05C 2203/0817; F05C 2203/034; F05C 2203/0843
USPC ..... 123/198 R; 28/888.01
See application file for complete search history.

(56) References Cited

U.S. PATENT DOCUMENTS 5,477,820 A * 12/1995 Rao ..... 123/193.6
2004/0137259 A1* 7/2004 Pabla et al. ..... 428/650

FOREIGN PATENT DOCUMENTS

EP 2 175 116 A1 4/2010
GB 1460654 A * 1/1977 ..... F01C 21/08
JP 60-184950 A 9/1985

(Continued)

OTHER PUBLICATIONS

International Search Report and Written Opinion for corresponding International Patent Application No. PCT/IB2011/002890 mailed May 29, 2012.

*Primary Examiner* — Lindsay Low
*Assistant Examiner* — Kevin Lathers
(74) *Attorney, Agent, or Firm* — Sughrue Mion, PLLC

(57) ABSTRACT

A heat-shielding film formed on the wall surface of a metal base material contains a plurality of ceramic hollow particles (1) and metal phases (2) to which the plurality of ceramic hollow particles (1) are joined at points. Each of the plurality of ceramic particles (1) is joined at a point, through the metal phase (2), to another ceramic particle among the plurality of ceramic particles (1) so that the plurality of ceramic particles (1) are joined to each other. The plurality of ceramic hollow particles (1) of the heat-shielding film (10) and the wall surface are joined at points to the metal phases (2) so that the plurality of ceramic hollow particles (1) are joined to the wall surface.

13 Claims, 9 Drawing Sheets

(56) References Cited

FOREIGN PATENT DOCUMENTS

| | | | |
|---|---|---|---|
| JP | 2009-243352 | A | 10/2009 |
| JP | 2009-243355 | A | 10/2009 |
| JP | 2012-046784 | A | 3/2012 |
| WO | 2012/025812 | A2 | 3/2012 |

* cited by examiner

HEAT-SHIELDING FILM AND METHOD OF FORMING THE SAME

BACKGROUND OF THE INVENTION

1. Field of the Invention

The invention relates to a heat-shielding film formed on a wall surface of a metal base material and a method of forming the same, and relates to, for example, a heat-shielding film formed on a portion or the entirety of a wall surface facing the combustion chamber of an internal combustion engine and a method of forming the same.

2. Description of Related Art

Internal combustion engines such as gasoline engines and diesel engines are constituted mainly by an engine block and a cylinder head, the combustion chamber thereof being defined by the bore surface of a cylinder block, a piston top surface inserted into the bore, the bottom surface of the cylinder head, and the top surfaces of intake and exhaust valves disposed inside the cylinder head. Along with the higher power required of present-day internal combustion engines, reducing the cooling loss thereof becomes important, and one of the measures to reduce this cooling loss is the method of forming a heat-shielding film made of ceramics on the internal wall of the combustion chamber.

However, since the ceramics in general have a low thermal conductivity and a high heat capacity, a drop in the intake efficiency or knocking (abnormal combustion caused by stagnant heat inside the combustion chamber) occur, due to a constant rise in surface temperature. Therefore, they are currently not prevalent as a coating material for the internal wall of a combustion chamber.

Thus, it is desirable that a heat-shielding film on the wall surface of a combustion chamber should be formed of a material that is heat-resistant and heat-insulating while also having low thermal conductivity and low heat capacity. In addition, along with having this low thermal conductivity and low heat capacity, the heat-shielding film is preferably a coat that has deforming capability allowing the film to deform in accordance with the combustion pressure at combustion time, the injection pressure, and the repetitions of thermal expansion and thermal contraction inside the combustion chamber, and is preferably a coat in which peeling is unlikely to occur due to the amount of thermal deformation at the interface with the base material of the cylinder block or the like.

Here, each of Japanese Patent Application Publication No. 2009-243352 (JP-A-2009-243352) and Japanese Patent Application Publication No. 2009-243355 (JP-A-2009-243355) discloses an internal combustion engine having a thin film for heat-insulation in which air cavities are formed inside a material having a lower thermal conductivity than the base material forming the combustion chamber of the internal combustion engine and having a heat capacity that is equal to that of the base material or lower than that of the base material.

Each of the JP-A-2009-243352 and JP-A-2009-243355 above describes a technique for forming a coat with low thermal conductivity and low heat capacity on the internal wall of the combustion chamber of an internal combustion engine, and thus, a heat-insulating film (heat-shielding film) with excellent capability may be formed as described above.

However, since air cavities are formed in the heat-insulating material made of ceramics or the like in the heat-insulating film structure, it is difficult to expect that the heat-insulating film has satisfactory deforming capability. For this reason, in a process in which the heat-insulating film undergoes repeated stresses from thermal expansion and thermal contraction inside the combustion chamber, damages by thermal fatigue may be caused, and furthermore, the thermal deformation difference between the heat-insulating film and the aluminum base material is likely to increase, and peeling is likely to occur at the interface between the heat-insulating film and the base material.

SUMMARY OF THE INVENTION

The invention provides a heat-shielding film which has low thermal conductivity and low heat capacity, and has deforming capability that allows the film to deform in accordance with the repetitions of thermal expansion and thermal contraction, and in which peeling is unlikely to be caused by thermal deformation difference at the interface with the wall surface of the metal base material of a cylinder block or the like, and a method of forming this heat-shielding filth on a wall surface.

A first aspect of the invention relates to a heat-shielding film formed on the wall surface of a metal base material. This heat-shielding film contains a plurality of ceramic hollow particles, and metal phases to which the plurality of ceramic hollow particles are joined at points. Each of the plurality of ceramic hollow particles is joined at a point, through the metal phase, to another ceramic hollow particle among the plurality of ceramic hollow particles so that the plurality of ceramic hollow particles are joined to each other. The plurality of ceramic hollow particles of the heat-shielding film and the wall surface are joined at points to the metal phases so that the plurality of ceramic hollow particles are joined to the wall surface.

The heat-shielding film according to the above aspect of the invention is formed over the wall surface, the base material metal of which is made of, for example, aluminum, steel, titanium, nickel, copper or an alloy thereof. In addition to a wall surface facing the combustion chamber of an internal combustion engine, a variety of wall surfaces requiring low thermal conductivity and low heat capacity can be cited as examples of this wall surface. For example, the heat-shielding film according to the above aspect of the invention may be applied to the wall surfaces that constitute the intake and exhaust lines of a vehicle, the wall surfaces that constitute a turbine blade, and the external walls of an internal combustion engine, a residential building, a housing for accommodating a space shuttle or the like. Then, in the case where the heat-shielding film is applied to an internal combustion engine, the internal combustion engine may be either a gasoline engine or a diesel engine. Furthermore, the heat-shielding film may be applied to all the wall surfaces constituting the combustion chamber of the internal combustion engine, that is, the bore surface of the cylinder block, the piston top surface inserted into the bore, the bottom surface of the cylinder head, and the top surfaces of intake and exhaust valves disposed inside the cylinder head. Alternatively, the heat-shielding film may be applied to any one or a plurality among the wall surfaces constituting the combustion chamber of the internal combustion engine.

As examples of ceramic hollow particle, alumina hollow particles, silica hollow particles, hollow particles made of a composite of alumina and silica (a material obtained by binding both particles), and the like, can be cited. Furthermore, in the heat-shielding film, the hollow particles are joined to each other at points through the metal phases, and thus, the heat-shielding film has a layer structure. When the thickness of one layer is determined by the average particle size of the hollow particles, the film may have one layer of a plurality of hollow particles, or the film may have two or more layers (in the case of a heat-shielding film having two or more layers, thickness of the heat-shielding film is the sum of the average particle size of the hollow particles forming each layer).

The heat-shielding film may be formed using ceramic hollow particles having one average particle size, or the heat-shielding film may be formed using ceramic hollow particles having two or more different average particle sizes. Furthermore, in the latter embodiment, a layer of the relatively large-size ceramic hollow particles may be joined to the wall surface through the metal phases, or a layer of the relatively small-size ceramic hollow particles may be joined to the wall surface through the metal phases.

Here, the phrase "a plurality of ceramic hollow particles are joined at points to metal phases" signifies that adjacent ceramic hollow particles are joined to each other through a metal phase, the width of which is narrower than the particle size of the hollow particles. For example, metal particles are melted, and then sintered, and thus, the molten metal forms the phase that is relatively small with respect to the ceramic hollow particles while shrinking by capillarity between the ceramic hollow particles, and the phase is joined to surrounding ceramic hollow particles. Thus, the ceramic hollow particles are joined (joined at a point) to the metal phase, which is relatively narrow in width.

This metal phase may be formed by melting nanoparticles made of any one among silver, copper and gold, followed by sintering.

Metal particle having an average particle size in the range of, for example, tens of nanometers to hundreds of nanometers are preferably used when melting metal particles, since the smaller the particle size thereof, the lower the temperature at which the metal particles can be melted (for example, although the original melting point of silver is approximately 1,000° C., nanoparticles of silver with the particle size of approximately 300 nm can be melted at a relatively low temperature of approximately 500° C.), and if the particle size is too small, production of the nanoparticles per se is difficult. The metal materials cited above can form nanoparticles and are difficult to oxidize. Therefore, the metal materials cited above are preferably used.

Since the heat-shielding film according to the above aspect of the invention is a thin film containing ceramic hollow particles, the heat-shielding film has low thermal conductivity and low heat capacity. In addition, owing to adjacent ceramic hollow particles being joined at a point to each other through the metal phase that is relatively small compared to the ceramic hollow particles, the film structure of the heat-shielding film is a structure having excellent deforming capability (flexibility).

Understanding the deforming capability resulting from this film structure is facilitated by a structural comparison with a heat-insulating film in which air cavities are formed within a heat-insulating material made of ceramics or the like, and which is described in the above JP-A-2009-243352 and JP-A-2009-243355. That is to say, in the case of the ceramic film described in JP-A-2009-243352 and JP-A-2009-243355, the internal structure thereof is a block structure, which is hard owing to the ceramics. Therefore, when a relatively low external pressure acts on this heat-insulating film, the block structure thereof can be maintained, while cracks are readily formed within the film due to low deforming capability when a relatively high external pressure that would deform the heat-insulating film acts thereon.

The wall surface formed of a metal base material, where the heat-insulating film is formed, thermally expands and thermally contracts because of the metal. During thermal deformations of the wall surface, a heat-insulating film having low deforming capability cannot deform in accordance with the thermal deformations of the wall surface, and peeling is likely to occur at the interface between the wall surface and the heat-insulating film. Consequently, due to the low adhesive property, the durability of the heat-insulating film structure is low.

In contrast, in the heat-shielding film according to the above aspect of the invention, ceramic hollow particles are joined at points to each other through the metal phases. For this reason, while the ceramic hollow particles are strongly joined to the metal phases at points, the metal phases per se, which forth the joining points, have high deforming capability. In addition, the overall structure of the heat-shielding film is also a flexible net structure with sufficient deforming capability. Therefore, when an external pressure that is high enough to deform the heat-shielding film acts thereon, the heat-shielding film readily deforms with no crack or the like occurring therein, and the heat-shielding film can readily deform in accordance with large thermal deformations of the wall surface made of the metal base material. Consequently, a heat-shielding film structure, in which interfacial peeling is unlikely to occur and durability is high, can be formed by the wall surface and the heat-shielding film.

According to verifications by the inventors, it is estimated that, by applying the heat-shielding film to the wall surfaces constituting the combustion chamber of an internal combustion engine, for instance, a small supercharge direct injection diesel engine for a passenger car, a fuel efficiency improvement of 5% at the maximum can be achieved at a fuel efficiency optimum point corresponding to an engine speed of 2100 rpm and a mean effective pressure of 1.6 MPa. This fuel efficiency improvement of 5% is a value at which fuel efficiency improvement can be demonstrated as a clearly significant difference without being buried as measurement error during the experiments, and when the time taken for the surface temperature of the heat-shielding film to drop by 40° C. from 260° C. to 220° C. is approximately 45 msec, this is deemed to correspond to 5% improvement in fuel efficiency.

According to the inventors, it has been substantiated that, by applying the heat-shielding film according to the above aspect of the invention to the wall surfaces constituting the combustion chamber of an internal combustion engine, it is possible to achieve the 40° C. drop time of 39 msec, which is shorter than the 40° C. drop time of 45 msec corresponding to 5% improvement in fuel efficiency. This demonstrates that fuel efficiency can be improved by 5% or more as compared to internal combustion engines having a conventional structures.

A second aspect of the invention relates to a method of forming a heat-shielding film. In the heat-shielding film, a plurality of ceramic hollow particles are joined at points to metal phases, and each of the plurality of ceramic hollow particles is joined at a point, through the metal phase, to another ceramic hollow particle among the plurality of ceramic hollow particles so that the plurality of ceramic hollow particles are joined to each other. The plurality of ceramic hollow particles of the heat-shielding film are joined to the wall surface of the metal base material at points through the metal phases. The method includes mixing the plurality of ceramic hollow particles with metal particle paste made of at least metal particles and a solvent to generate a slurry, applying the slurry to the wall surface of the metal base material, carrying out heating at a temperature that is a boiling point of the solvent or higher to volatilize the solvent, and further carrying out heating at a temperature that is a melting temperature of the metal particles or higher to melt the metal particles and to sinter molten metal between the plurality of ceramic hollow particles so that the metal phases are formed.

As the ceramic hollow particles to be used, it is possible to use any one species of hollow particles or a plurality of species of hollow particles selected from the group consisting of alumina hollow particles, silica hollow particles, hollow particles made of a composite of alumina and silica, as already described. In the hollow particle preparation method, which is not limited in particular, for example, polymer powder having an average particle size of tens of μm and ceramic powder having a sub-micron or smaller size are placed inside a rotating chamber and the rotating chamber is rotated at high speed to prepare composite particles in which the polymer powder surface is coated with the ceramic powder with a thickness that is as uniform as possible. Next, the composite particles are subjected to calcination at 1,000° C. or higher, for example, to thermally decompose (gasify) the polymer powder of the composite particles, thereby producing the ceramic hollow particles. By adjusting the particle size of the polymer powder in the preparation method, the particle size of the ceramic hollow particles is controlled to a desired particle size. In addition, when the ceramic hollow particles are hollow particles made of a composite of alumina and silica, alumina and silica are placed inside the rotating chamber to coat the polymer powder surface with alumina and silica, and sintering is performed. Thus, the ceramic hollow particles made of the composite in which alumina and silica are bonded are produced.

Depending on the species of the solvent forming the slurry, the boiling point thereof differs and, for example, the first heat treatment is carried out at 100° C. when water is used as the solvent and at approximately 250° C. when a monoisobutylate solvent is used.

When nanoparticles of silver or the like is used as metal particles, the melting temperature thereof is approximately 500° C. as already described. Therefore, when silver nanoparticles are used, after solvent volatilization, heat treatment is carried out at an even higher temperature of 500° C. or higher to melt the silver nanoparticle between the ceramic hollow particles. The silver nanoparticles molten between the ceramic hollow particles are sintered to form the metal phase that is relatively small with respect to the ceramic hollow particles, while shrinking by capillarity. Thus, the metal phase is joined at points to the ceramic hollow particles, thereby forming the heat-shielding film.

Then, at the same time as the formation of the heat-shielding film, silver nanoparticles molten similarly between each ceramic hollow particle of the heat-shielding film and the wall surface also form the metal phase while shrinking by capillarity. Thus, the ceramic hollow particles and the wall surface are joined at points to the metal phases. In addition, each ceramic hollow particle is joined at a point to the wall surface through the metal phase, thereby forming a connection structure having high bonding strength and excellent deforming capability.

As can be understood from the above description, in the heat-shielding film and method of forming the same according to the above aspects of the invention, each of the plurality of ceramic hollow particles is joined at a point to the metal phase so that the plurality of ceramic hollow particles are joined to each other, and thus, this heat-shielding film is formed. In addition, the plurality of ceramic hollow particles of the heat-shielding film and the wall surface are also joined at points to the metal phases so that the plurality of ceramic hollow particles are joined to the wall surface. Therefore, the heat-shielding film has low thermal conductivity, low heat capacity, excellent deforming capability, and high connection strength. Moreover, it is possible to form the heat-shielding film structure that is joined to the wall surface of the metal base material through the connection structure having excellent deforming capability.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, the heat-shielding film and the method of forming the same in embodiments of the invention will be described with references to drawings. In the illustrated examples, the heat-shielding film is applied to a wall surface facing the combustion chamber of an internal combustion engine; however, in addition to the wall surface facing the combustion chamber, a variety of wall surfaces requiring low thermal conductivity and low heat capacity can be cited as examples of wall surfaces to which the heat-shielding film is applied. For example, the heat-shielding film may be applied to the wall surfaces that constitute the intake and exhaust lines of a vehicle, the wall surfaces that constitute a turbine blade, and the external walls of an internal combustion engine, a residential building, a housing for accommodating a space shuttle or the like.

FIG. 1, FIG. 2 and FIGS. 3A to 3C are vertical sectional views showing the heat-shielding films formed on the wall surface of a metal base material in first to fifth embodiments of the invention.

Figure 1:
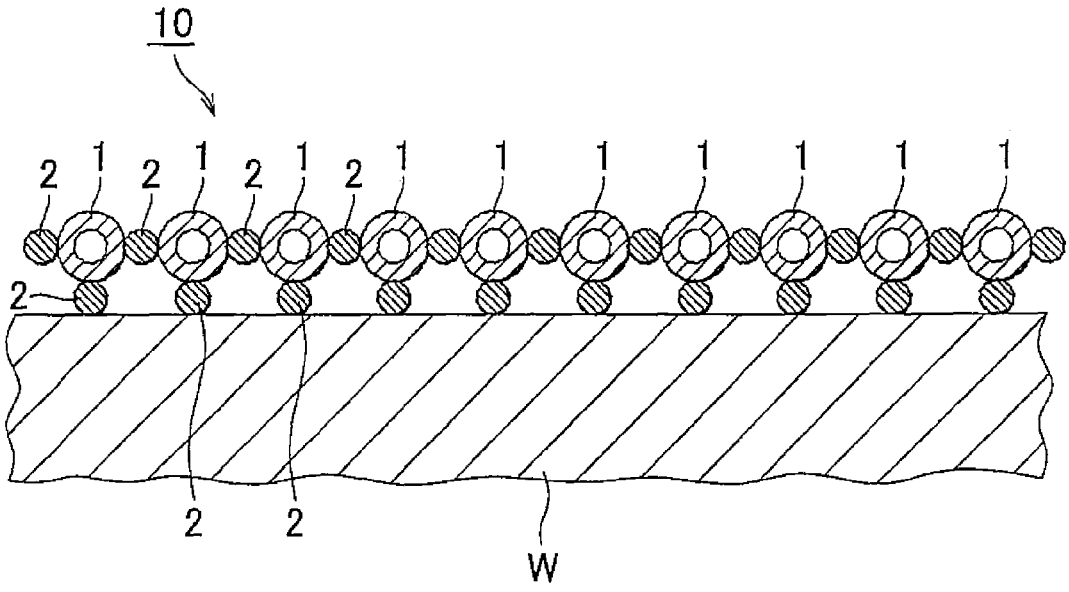
FIG. 1 is a vertical sectional view of a heat-shielding film formed on a wall surface of a metal base material according to a first embodiment of the invention.

In a heat-shielding film 10 shown in FIG. 1, each of a plurality of ceramic hollow particles 1 is joined at a point to a metal phase 2, and ceramic hollow particles 1 are joined at a point to each other through the metal phase 2. Thus, the heat-shielding film 10 with one layer is formed. In other words, each ceramic hollow particle 1 is joined at a point to another ceramic hollow particle 1 through the metal phase 2 so that the plurality of ceramic hollow particles 1 are joined to each other. In addition, each of the ceramic hollow particles 1 is joined at a point to a wall surface W through the metal phase 2.

This "the ceramic hollow particle 1 and the metal phase 2 are joined at a point", as is also apparent from the drawing, refers to the fact that the metal phase 2, which is narrow in width and small compared to the size of the ceramic hollow particle 1, is joined to the ceramic hollow particle 1.

The ceramic hollow particles 1 used here have substantially the same particle size, and are all made of the same ceramic material.

Examples of the ceramic material of the ceramic hollow particle 1 include alumina, silica, a composite of alumina and silica (a material obtained by binding both particles), and the like.

The metal phase 2 is formed by melting nanoparticles (metal particles having an average particle size in the range of tens of nanometers to hundreds of nanometers) of any one species among silver, copper and gold, followed by sintering. The metal nanoparticles are melted and sintered between the ceramic hollow particles 1 and 1, and are solidified while shrinking by capillarity. Thus, a joining point is formed as in the illustrated example.

The base material metal constituting the wall surface is made of, for example, aluminum, steel, titanium, nickel, copper or an alloy thereof. One example of the wall surface is the wall surface facing the combustion chamber of an internal combustion engine.

The heat-shielding film 10 shown in FIG. 1 has a plurality of ceramic hollow particles 1 each strongly joined at a point to the metal phase 2 and the structure of the heat-shielding film 10 is a net structure. Thus, the heat-shielding film 10 has low thermal conductivity and low heat capacity and at the same time has excellent deforming capability as a result of combination of the deforming capability exerted by the net structure and the deforming capability of the metal phase 2 per se, which forms the joint.

In addition, similarly, the plurality of ceramic hollow particles 1 of the heat-shielding film 10 and the wall surface W are joined at points to the metal phases 2 so that the plurality of ceramic hollow particles 1 and the wall surface W are joined to each other. Therefore, the joint interface has high bonding strength and excellent deforming capability.

Figure 2:
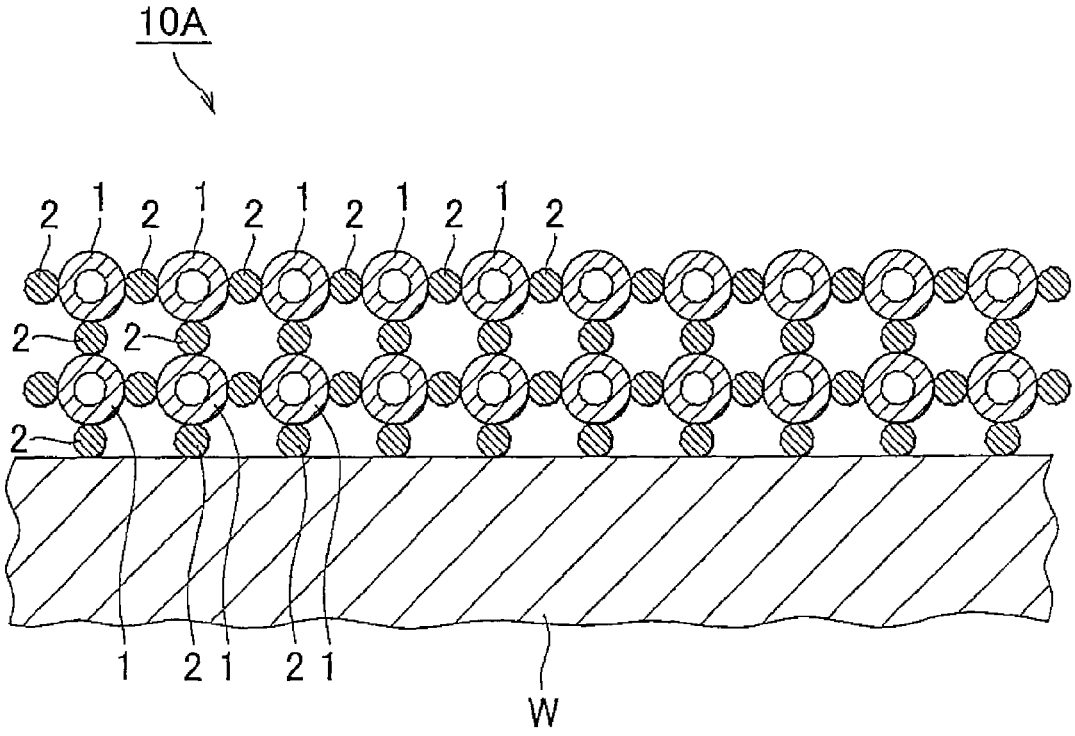
FIG. 2 is a vertical sectional view of a heat-shielding film formed on a wall surface of a metal base material according to a second embodiment of the invention.

In a heat-shielding film 10A shown in FIG. 2, the hollow particles 1, which have substantially the same particle size and are made of the same ceramic material, are joined at points to the metal phases 2. The heat-shielding film 10A has a two-layer structure.

Compared to the heat-shielding film 10 shown in FIG. 1, the heat-shielding film 10A shown in FIG. 2 has a two-layer structure. Therefore, the heat-shielding film 10A has the advantage of being able to maintain the heat-insulating capability of the heat-shielding film 10A even when a defect occurs at a part of the joining points at which the hollow particles 1 are joined to the metal phases 2. According to the inventors, it has been found that, even if a heat-shielding film having three or more layers is formed, the heat-insulating capability thereof does not improve significantly. When this fact, material costs, efficiency of heat-shielding film formation, and the like are comprehensively taken into consideration, a heat-shielding film with a one-layer structure or a two-layer structure, such as the heat-shielding films 10 and 10A, is desirable.

Figure 3A:
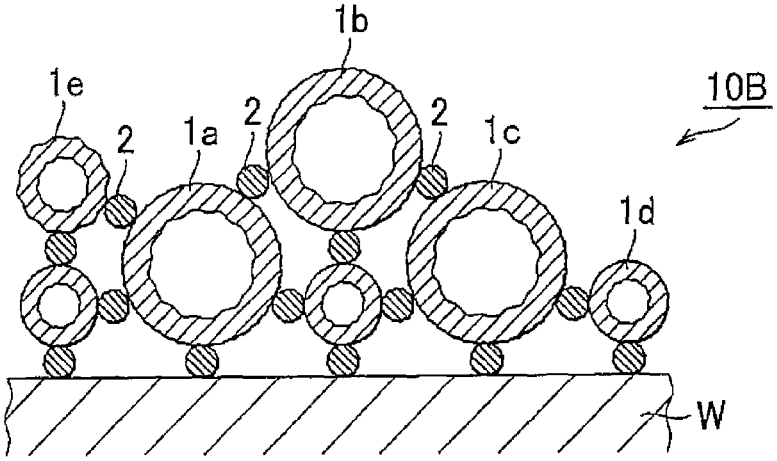
FIGS. 3A, 3B and 3C are vertical sectional views of heat-shielding films formed on a wall surface of a metal base material according to third, fourth and fifth embodiments of the invention, respectively.

A heat-shielding film 10B shown in FIG. 3A is a heat-shielding film formed using several species of ceramic hollow particles 1*a*, 1*b*, 1*c*, 1*d* and 1*e* having different particle sizes.

Figure 3B:
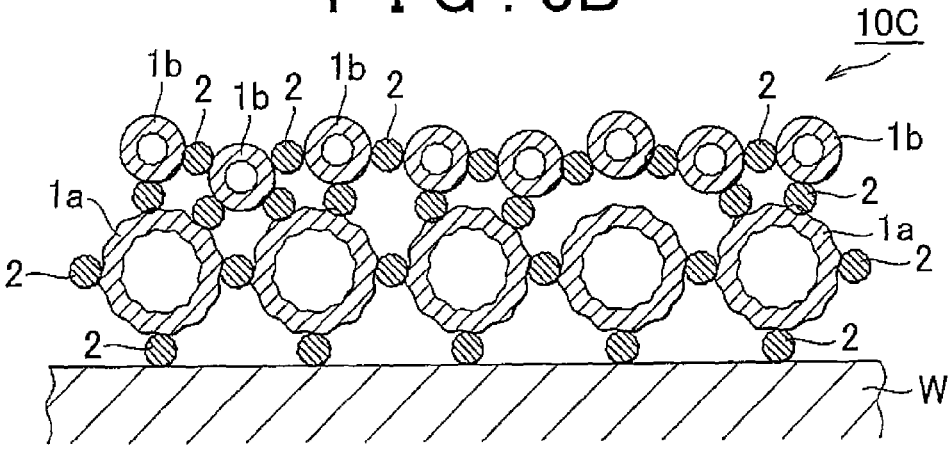

In addition, a heat-shielding film 10C shown in FIG. 3B is a two-layer structure heat-shielding film made by joining a layer of the relatively large-size ceramic hollow particles 1*a* to the wall surface W through the metal phases 2, disposing a layer of the relatively small-size ceramic hollow particles 1*b* over the layer of the ceramic hollow particles 1*a*, and joining the layer of the ceramic hollow particles 1*b* to the layer of the ceramic hollow particles 1*a*. That is, two layers are formed by the ceramic hollow particles 1*a* and 1*b*.

Figure 3C:
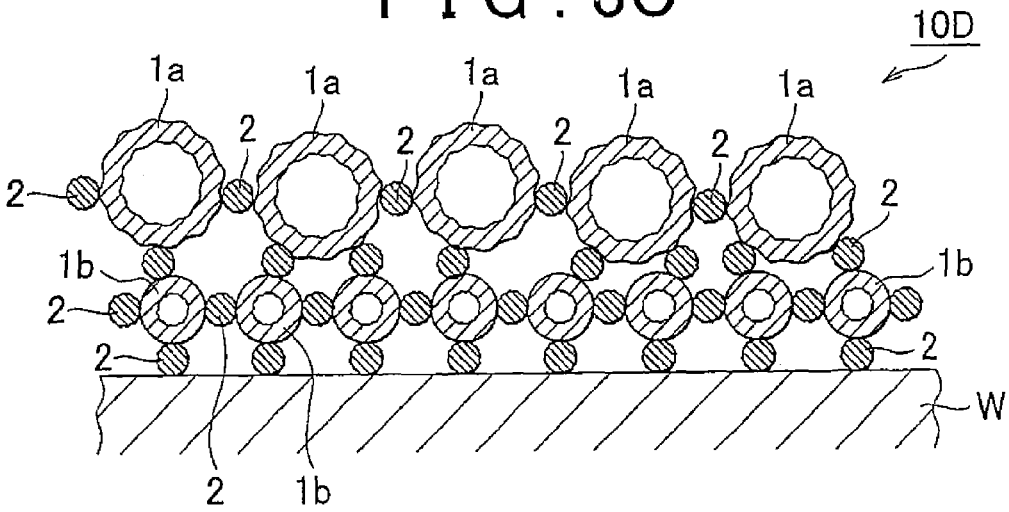

A heat-shielding film 10D shown in FIG. 3C is a two-layer structure heat-shielding film having an opposite structure from the heat-shielding film 10C. The heat-shielding film 10D is made by joining a layer of the relatively small-size ceramic hollow particles 1*b* to the wall surface W through the metal phases 2, disposing a layer of the relatively large-size ceramic hollow particles 1*a* over the layer of the ceramic hollow particles 1*b*, and joining the layer of the ceramic hollow particles 1*a* to the layer of the ceramic hollow particles 1*b*.

The structure of each of the above heat-shielding films 10 and 10A to 10D is a net structure. In each of the above heat-shielding films 10 and 10A to 10D, the ceramic hollow particles are joined to the metal phases 2 at points, and thus, the ceramic hollow particles are strongly joined to the wall surface W through the metal phases 2 in a manner such that the heat-shielding film has deforming capability.

Figure 4:
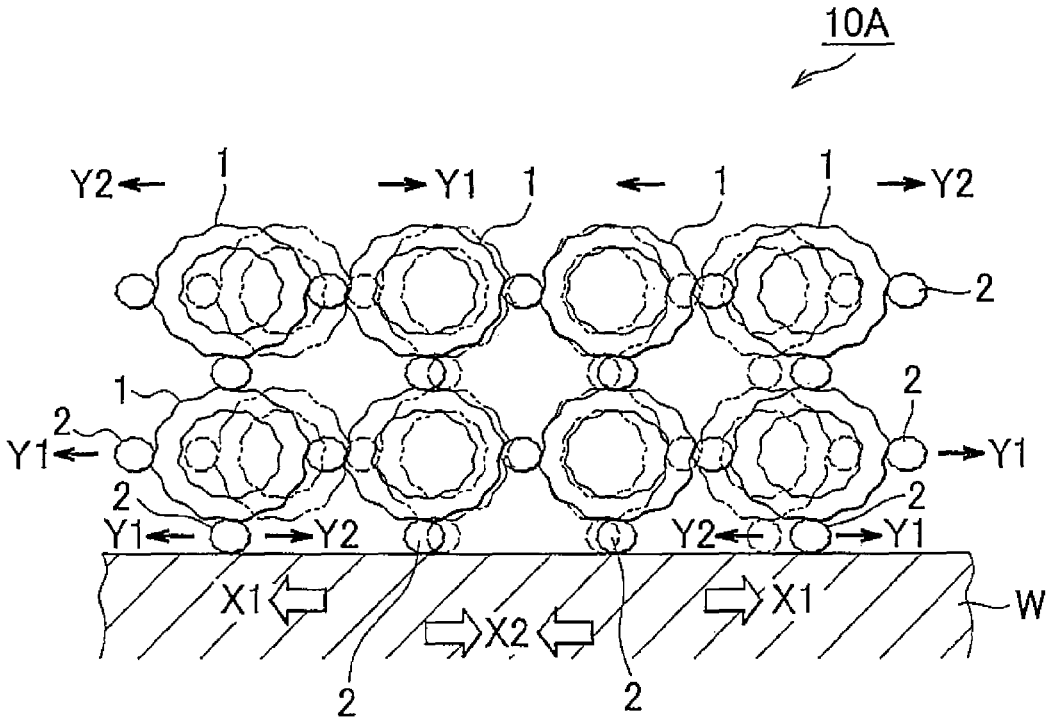
FIG. 4 is a schematic diagram describing the thermal deformation of the wall surface and a manner in which the heat-shielding film deforms in accordance with the thermal deformation.

FIG. 4 is a schematic diagram describing the thermal deformation of the wall surface and a manner in which the heat-shielding film deforms in accordance with the thermal deformation.

As already mentioned, the heat-shielding film 10A assumes a net structure with each of the ceramic hollow particles 1 strongly joined at a point to the metal phase 2. Therefore, when the wall surface W made of the metal base material thermally expands (X1 direction) or thermally contracts (X2 direction) significantly, the metal phase 2 forming the joining point at the interface deforms (Y1 direction and Y2 direction), furthermore, the metal phase 2 between the ceramic hollow particles 1 and 1 constituting the heat-shielding film 10A deforms similarly (Y1 direction and Y2 direction), thereby allowing the heat-shielding film 10A to deform in accordance with the thermal deformation of the wall surface W without cracks or the like occurring in the heat-shielding film 10A per se.

Thus, even in a combustion chamber of an internal combustion engine where the thermal deformation of the wall surface W is intense, peeling is unlikely to occur at the interface between the heat-shielding film formed on the wall surface W and the wall surface W. Thus, the highly durable heat-shielding film structure is provided.

Figure 5A:
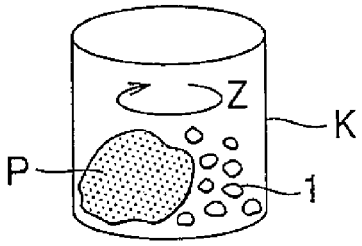
FIGS. 5A to 5C show a flow-chart describing, in the order of FIGS. 5A, 5B and 5C, a method of forming the heat-shielding film in the invention.
Figure 5B:
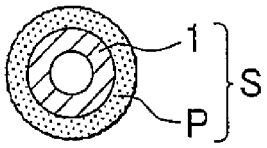
Figure 5C:
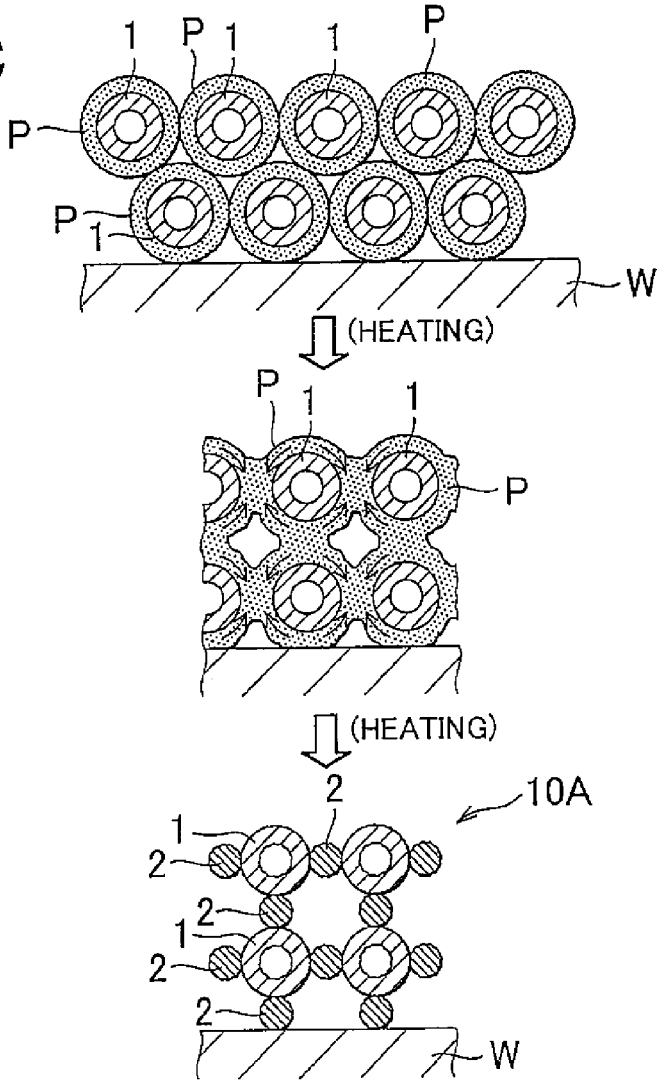

Next, with references to FIGS. 5A to 5C, a method of forming the heat-shielding film of the invention will be outlined. FIGS. 5A to 5C show a flow-chart describing, in the order of FIGS. 5A, 5B and 5C, a method of forming the heat-shielding film. In the example shown in FIGS. 5A to 5C, Ag nanoparticles are used as the metal particles and a composite of $Al_2O_3$ and $SiO_2$ is used as the ceramic hollow particles.

First, as shown in FIG. 5A, ceramic hollow particles 1 made of the composite of $Al_2O_3$ and $SiO_2$, and an Ag paste P containing Ag nanoparticles (with an average particle size of approximately 300 nm), glass frit, a cellulose resin and a monoisobutylate solvent are introduced into a container K and stirred sufficiently to generate a slurry S in which the Ag paste P is attached around each hollow particle 1 made of the composite of $Al_2O_3$ and $SiO_2$ as shown in FIG. 5B.

The preparation method for the ceramic hollow particles 1 made of the composite of $Al_2O_3$ and $SiO_2$ introduced into the container K is as follows. That is to say, polymer powder having an average particle size of tens of μm, $Al_2O_3$ powder and $SiO_2$ powder having a sub-micron or smaller size are placed inside a rotating chamber (not shown), the rotating chamber is rotated at high speed thereby preparing composite particles in which the polymer powder surface is coated with the $Al_2O_3$ powder and the $SiO_2$ powder with a thickness that is as uniform as possible. Next, the composite particles are subjected to calcination at 1,000° C. or higher, for example, to thermally decompose (gasify) the polymer powder of the composite particles, thereby producing hollow particles made of the composite in which $Al_2O_3$ and $SiO_2$ are bonded.

The generated slurry S is applied to the wall surface W as in the top figure of FIG. 5C, followed by heat treatment at a temperature of approximately 250° C., which is the boiling point of the monoisobutylate solvent, or higher.

When the solvent is volatilized by the heat treatment, the paste P condenses in the periphery of the hollow particle 1, as shown in the middle figure of FIG. 5C.

By heat treatment at a temperature of approximately 500° C., which is the melting point of the Ag nanoparticles, or higher, the volatilization of the solvent proceeds, and at the same time, the Ag molten between the hollow particles 1 and 1 or between the hollow particle 1 and the wall surface W is sintered while shrinking by capillarity. As a result, the metal phase 2, which forms the joining point, is formed, the hollow particles 1 and 1 are joined to each other, and the hollow particle 1 and the wall surface W are joined, as shown in the bottom figure of FIG. 5C.

Figure 6:
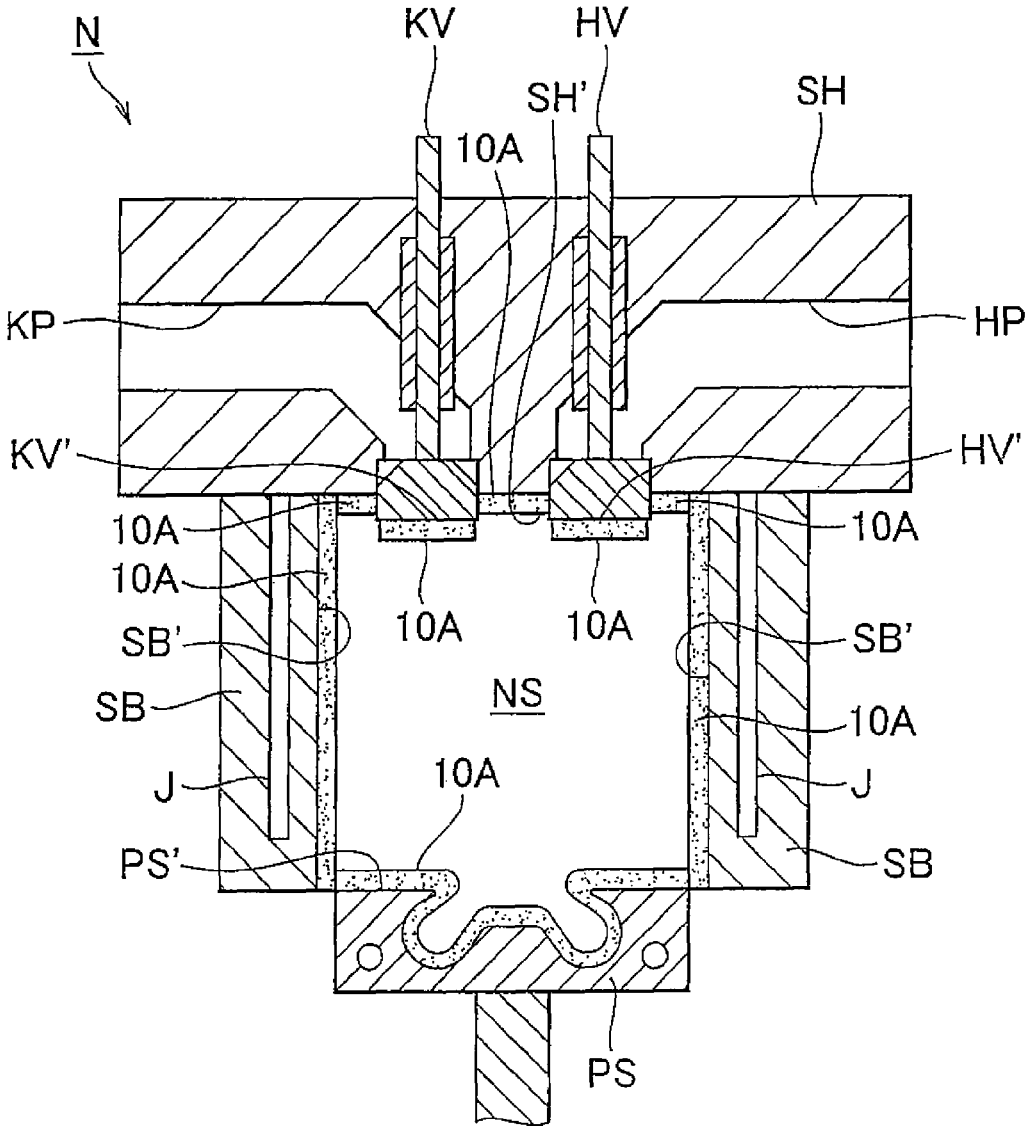
FIG. 6 is a vertical sectional view describing an example in which a heat-shielding film has been applied to a wall surface facing the combustion chamber of an internal combustion engine.

FIG. 6 is a vertical sectional view describing an example in which the heat-shielding film formed through the forming method has been applied to wall surfaces facing the combustion chamber of an internal combustion engine.

The illustrated internal combustion engine N is a diesel engine provided with a cylinder block SB having a coolant jacket J formed therein, a cylinder head SH disposed above the cylinder block SB, an intake port KP and an exhaust port HP defined inside the cylinder head SH, an intake valve KV and an exhaust valve HV liftably mounted in the openings of the intake port KP and the exhaust port HP facing a combustion chamber NS, and a piston PS formed liftably from the lower opening of the cylinder block SB. It is obvious that the internal combustion engine of the invention may be a gasoline engine.

Each of constitutive members constituting the internal combustion engine N is formed using aluminum or an alloy thereof. The constitutive members may be formed using materials other than aluminum or an alloy thereof and the surface of the constitutive members may be aluminized with aluminum or an alloy thereof.

Inside the combustion chamber NS defined by the constitutive members of the internal combustion engine N, the heat-shielding film 10A shown in FIG. 2 having a given thickness is formed on the wall surfaces facing the combustion chamber NS (cylinder bore surface SB', cylinder head bottom surface SH', piston top surface PS', valve top surfaces KV' and HV').

Since the heat-shielding film 10A is formed on the wall surfaces facing the combustion chamber NS of the internal combustion engine N, the heat-shielding film structure is highly durable and has excellent heat-insulating ability, furthermore, has a so-called swing characteristic in which the temperature of the heat-shielding film 10A changes in accordance with a change in the gas temperature inside the combustion chamber NS.

Cooling Test and Results

Figure 7A:
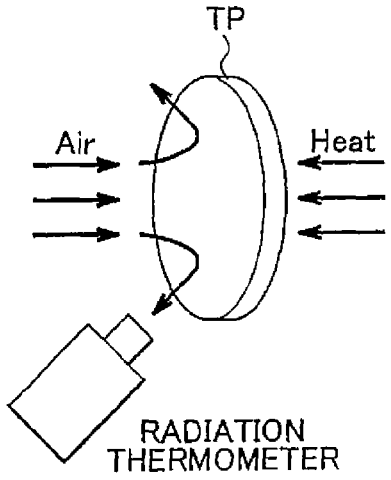
FIG. 7A is a schematic diagram describing the overview of a cooling test and FIG. 7B shows a cooling curve based on the cooling test results and the 40° C. drop time determined from the cooling curve.
Figure 7B:
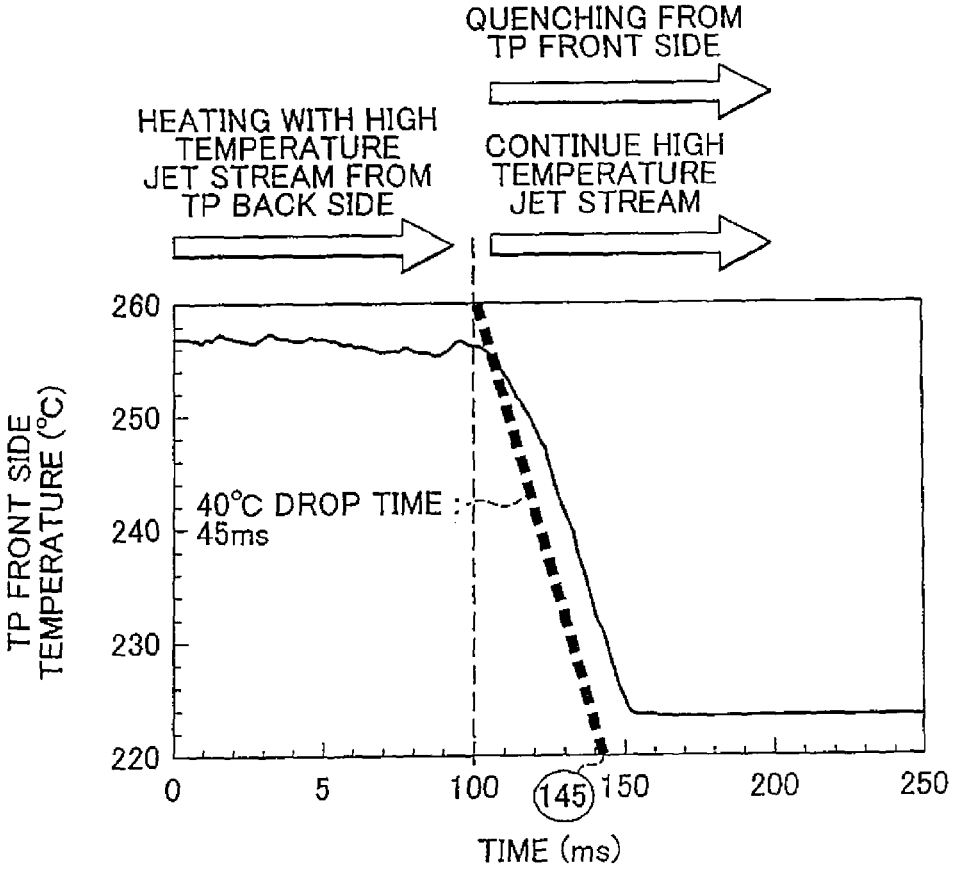

The inventors conducted cooling test, and thus, performed experiments to verify improvement of fuel efficiency of an internal combustion engine in which the heat-shielding film of the invention was formed. In the summary of the cooling test, as shown in FIG. 7A, a test piece TP with a heat-shielding film applied only on one side is used, and the back side (the side with no heat-shielding film applied) is heated with a high temperature jet at 750° C. (refer to the Heat arrows in the figure) so that the entire test piece TP is maintained at approximately 250° C. Then, a nozzle, through which a room temperature jet stream has been flowing at a given flow rate, is moved to the front side of the test piece TP (the side with the heat-shielding film applied) by a linear motor to begin cooling (this provides 25° C. cooling air (refer to the Air arrows in the figure); in so doing, the high temperature jet on the back side continues). The temperature of the heat-shielding film surface of the test piece TP is measured with a radiation thermometer located outside, and the temperature decrease at the time of the cooling is measured to create the cooling curve shown in FIG. 7B. The cooling test is a test method simulating the combustion chamber internal wall during the intake stroke. The cooling test evaluates the cooling rate of the heated heat-shielding film surface. In the case of a heat-shielding film having low thermal conductivity and low heat capacity, the quenching rate tends to be high.

The time required to decrease by 40° C. is read from the created cooling curve. The time required to decrease by 40° C. serves as the 40° C. drop time used to evaluate the heat characteristic of the coat. According to the inventors, the 40° C. drop time from 260° C. to 220° C., at which a fuel efficiency improvement rate of 5% is achieved, is determined to be 45 msec (500° C. swing characteristic). The value of 5% fuel efficiency improvement rate is a value at which the fuel efficiency improvement can be demonstrated definitely without being buried as a measurement error during the experiments, and the warming time of the $NO_x$ reduction catalyst can be shortened with the increase in exhaust gas temperature and $NO_x$ can be reduced. If the 40° C. drop time is 45 msec or shorter, the fuel efficiency improvement rate is 5% or greater.

In the experiment, a heat-shielding film with the conventional structure described in JP-A-2009-243352 and JP-A-2009-243355 (comparative example) and the heat-shielding film of the invention (example) were prepared to perform respective cooling tests, and the respective 40° C. drop times were measured. The measurement results are shown in FIG. 8.

Figure 8:
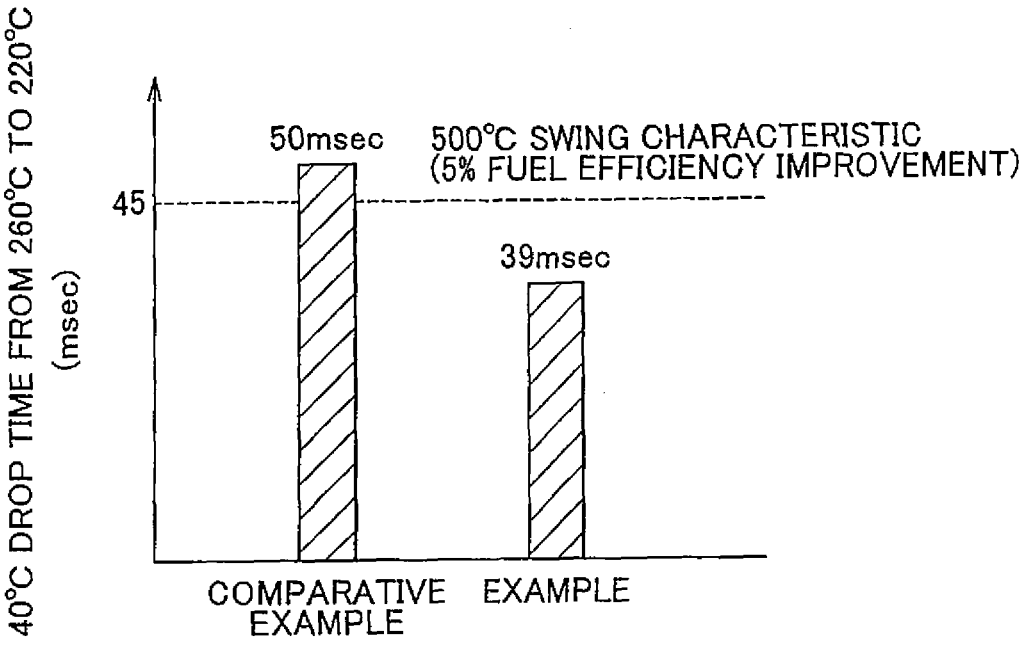
FIG. 8 is a graph showing the 40° C. drop times determined by the cooling test for a heat-shielding film having a conventional structure (comparative example) and a heat-shielding film of the invention (example)

FIG. 8 shows that the 40° C. drop time is 50 msec and the fuel efficiency improvement rate of 5% cannot be achieved in the comparative example, and in contrast, the 40° C. drop time is 39 msec that is significantly below 45 msec, and the fuel efficiency improvement rate of 5% or greater can be achieved in the example.

Figure 9:
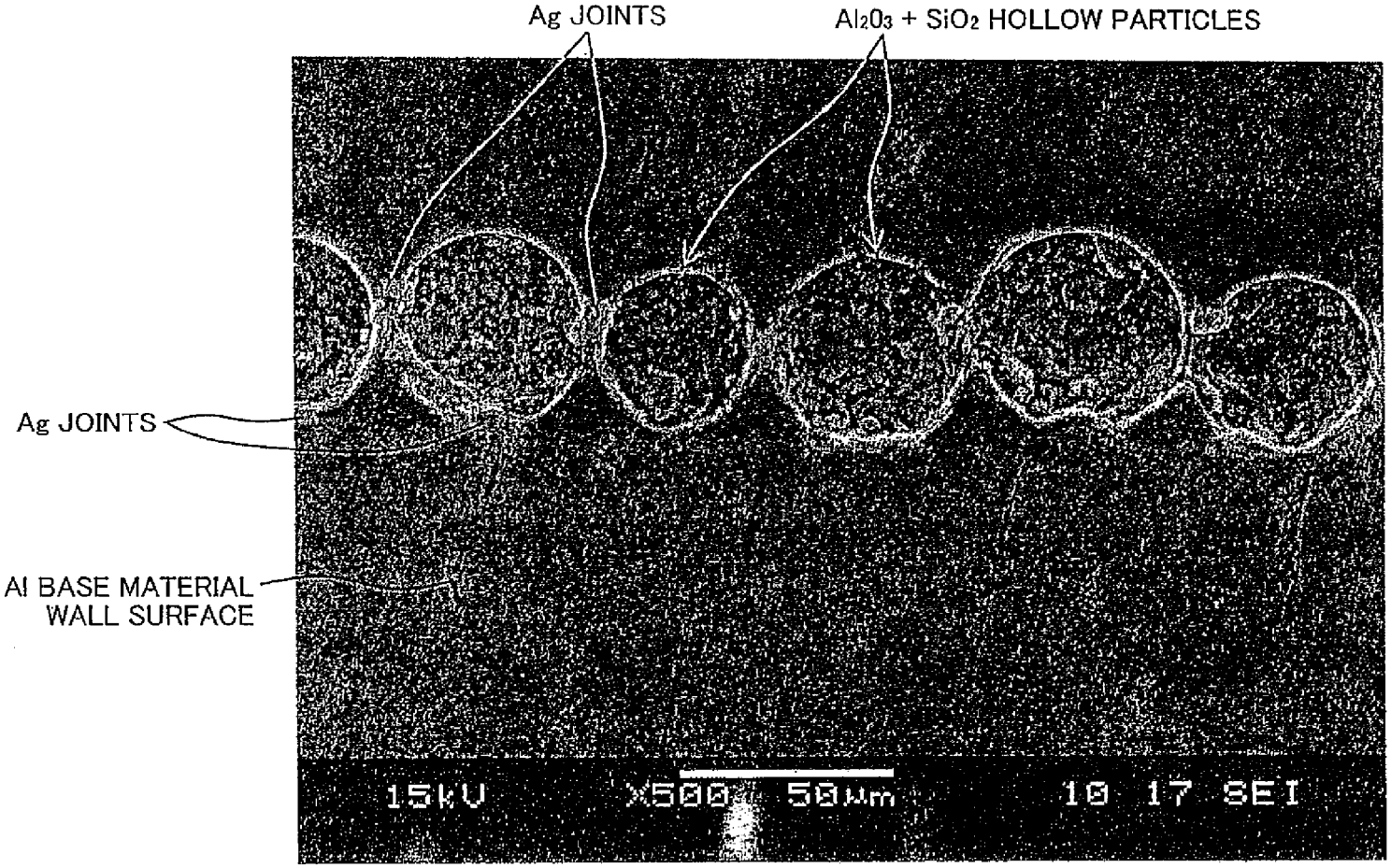
FIG. 9 is an SEM photograph of a heat-shielding film formed on a wall surface.
Figure 10A:
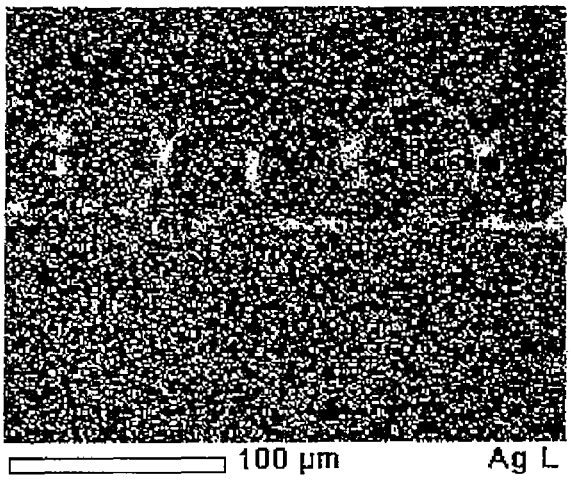
FIG. 10A is a photograph showing an Ag composition image in the SEM photograph of FIG. 9.
Figure 10B:
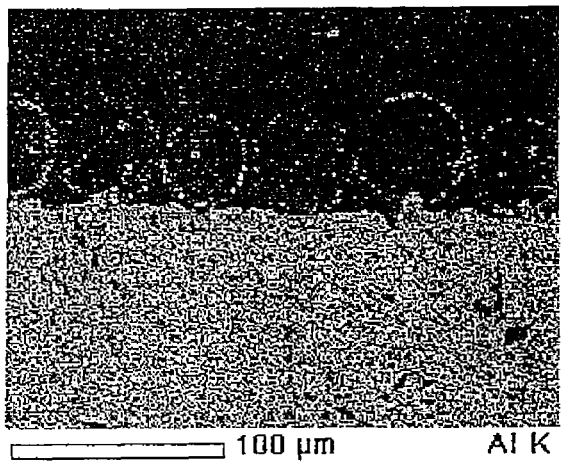
FIG. 10B is a photograph showing an Al composition image and FIG. 10C is a photograph showing an Si composition image.
Figure 10C:
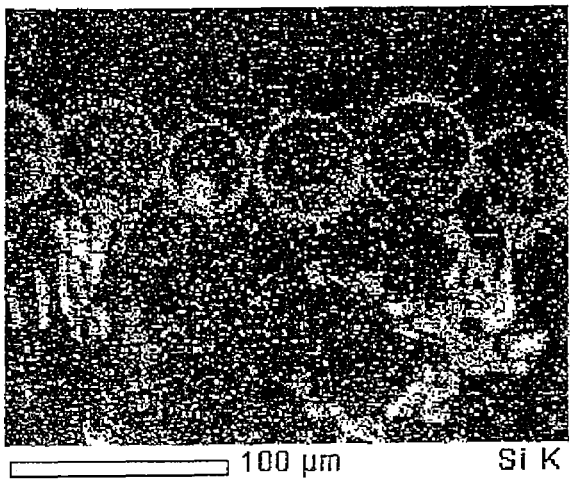

In addition, the inventors photographed SEM images of the heat-shielding film in which the hollow particles made of the composite in which $Al_2O_3$ and $SiO_2$ are bonded are joined at points to a wall surface through the metal phases made by melting silver nanoparticles followed by sintering. In addition to the overall photograph, the metal composition images were observed. FIG. 9 is the SEM photograph of the heat-shielding film formed on a wall surface, FIG. 10A is the photograph showing an Ag composition image in the SEM photograph of FIG. 9, FIG. 10B is the photograph showing an Al composition image, and FIG. 10C is the photograph showing an Si composition image.

Based on the figures, is possible to confirm that the ceramic hollow particles are joined at points to the metal phases so that the ceramic hollow particles are joined to each other, and thus, the heat-shielding film having a layer structure is formed, and that the ceramic hollow particles forming the heat-shielding film and the wall surface are also joined at points to the metal phases so that the ceramic hollow particles and the wall surface are joined to each other.

Thus, embodiments of the invention have been described in detail using figures; however, concrete configurations are not limited to the embodiments, and even if there are design modifications, or the like, within a scope that does not depart from the invention, they are included in the invention.

The invention claimed is:

1. A heat-shielding film formed on a wall surface of a metal base material, comprising:

a plurality of ceramic hollow particles; and metal phases to which the plurality of ceramic hollow particles are joined at points, wherein each of the plurality of ceramic hollow particles is joined at a point, through the metal phase, to another ceramic hollow particle among the plurality of ceramic hollow particles so that the plurality of ceramic hollow particles are joined to each other, and the plurality of ceramic hollow particles of the heat-shielding film and the wall surface are joined at points to the metal phases so that the plurality of ceramic hollow particles are joined to the wall surface, wherein the plurality of ceramic hollow particles consist of ceramic hollow particles having two different average particle sizes, a first layer of the ceramic hollow particles having a larger average particle size among the two different average particle sizes is joined to the wall surface through the metal phases, and a second layer of the ceramic hollow particles having a smaller average particle size among the two different average particle sizes is disposed above the first layer, and joined to the first layer.

2. The heat-shielding film according to claim 1, wherein the plurality of ceramic hollow particles consist of ceramic hollow particles having two or more different average particle sizes.

3. The heat-shielding film according to claim 1, wherein two layers are formed by the plurality of ceramic hollow particles.

4. The heat-shielding film according to claim 1, wherein the plurality of ceramic hollow particles consist of any one species of hollow particles or a plurality of species of hollow particles selected from the group consisting of alumina hollow particles, silica hollow particles and hollow particles made of a composite of alumina and silica.

5. The heat-shielding film according to claim 1, wherein the metal phase is formed by melting nanoparticles made of any one among silver, copper and gold, followed by sintering.

6. The heat-shielding film according to claim 1, wherein the wall surface is a wall surface facing a combustion chamber of an internal combustion engine.

7. A heat-shielding film formed on a wall surface of a metal base material, comprising:

a plurality of ceramic hollow particles; and metal phases to which the plurality of ceramic hollow particles are joined at points, wherein each of the plurality of ceramic hollow particles is joined at a point, through the metal phase, to another ceramic hollow particle among the plurality of ceramic hollow particles so that the plurality of ceramic hollow particles are joined to each other, and the plurality of ceramic hollow particles of the heat-shielding film and the wall surface are joined at points to the metal phases so that the plurality of ceramic hollow particles are joined to the wall surface, wherein the plurality of ceramic hollow particles consist of ceramic hollow particles having two different average particle sizes, a first layer of the ceramic hollow particles having a smaller average particle size among the two different average particle sizes is joined to the wall surface through the metal phases, and a second layer of the ceramic hollow particles having a larger average particle size among the two different average particle sizes is disposed above the first layer, and joined to the first layer.

8. A method of forming a heat-shielding film in which a plurality of ceramic hollow particles are joined at points to metal phases, and each of the plurality of ceramic hollow particles is joined at a point, through the metal phase, to another ceramic hollow particle among the plurality of ceramic hollow particles so that the plurality of ceramic hollow particles are joined to each other, wherein the plurality of ceramic hollow particles of the heat-shielding film are joined to a wall surface of a metal base material at points through the metal phases, the forming method comprising:

mixing the plurality of ceramic hollow particles with metal particle paste made of at least metal particles and a solvent to generate a slurry;

applying the slurry to the wall surface of the metal base material;

carrying out heating at a temperature that is a boiling point of the solvent or higher to volatilize the solvent; and further carrying out heating at a temperature that is a melting temperature of the metal particles or higher to melt the metal particles and to sinter molten metal between the plurality of ceramic hollow particles so that the metal phases are formed, wherein the plurality of ceramic hollow particles consist of ceramic hollow particles having two different average particle sizes, a first layer of the ceramic hollow particles having a larger average particle size among the two different average particle sizes is joined to the wall surface through the metal phases, and a second layer of the ceramic hollow particles having a smaller average particle size among the two different average particle sizes is disposed above the first layer, and joined to the first layer.

9. The method according to claim 8, wherein ceramic hollow particles having two or more different average particle sizes are used.

10. The method according to claim 8, wherein any one species of hollow particles or a plurality of species of hollow particles selected from the group consisting of alumina hollow particles, silica hollow particles and hollow particles made of a composite of alumina and silica are used as the plurality of ceramic hollow particles.

11. The method according to claim 8, wherein nanoparticles made of any one among silver, copper and gold are used as the metal particles.

12. The method according to claim 8, wherein the wall surface is a wall surface facing a combustion chamber of an internal combustion engine.

13. A method of forming a heat-shielding film in which a plurality of ceramic hollow particles are joined at points to metal phases, and each of the plurality of ceramic hollow particles is joined at a point, through the metal phase, to another ceramic hollow particle among the plurality of ceramic hollow particles so that the plurality of ceramic hollow particles are joined to each other, wherein the plurality of ceramic hollow particles of the heat-shielding film are joined to a wall surface of a metal base material at points through the metal phases, the forming method comprising:

mixing the plurality of ceramic hollow particles with metal particle paste made of at least metal particles and a solvent to generate a slurry;

applying the slurry to the wall surface of the metal base material;

carrying out heating at a temperature that is a boiling point of the solvent or higher to volatilize the solvent; and further carrying out heating at a temperature that is a melting temperature of the metal particles or higher to melt the metal particles and to sinter molten metal between the plurality of ceramic hollow particles so that the metal phases are formed, wherein the plurality of ceramic hollow particles consist of ceramic hollow particles having two different average particle sizes, a first layer of the ceramic hollow particles having a smaller average particle size among the two different average particle sizes is joined to the wall surface through the metal phases, and a second layer of the ceramic hollow particles having a larger average particle size among the two different average particle sizes is disposed above the first layer, and joined to the first layer.

* * * * *